US005337918A

United States Patent [19]

Wang

[11] Patent Number: 5,337,918

[45] Date of Patent: Aug. 16, 1994

[54] WATER BOTTLE WITH A HIDDEN SUCTION STRAW

[76] Inventor: Ching-Chen Wang, No. 8, Hsin Ai Rd., An Ping Industrial Dist., Tainan, Taiwan

[21] Appl. No.: 124,804

[22] Filed: Sep. 21, 1993

[51] Int. Cl.[5] ..... A47G 19/22; B65D 51/18

[52] U.S. Cl. ..... 220/708; 220/256; 220/705; 220/709; 215/1 A; 215/229; 222/507; 222/533; 222/536

[58] Field of Search ..... 215/1 A, 229; 220/212, 220/252, 253, 255, 256, 703, 705, 707, 708, 709, 717; 229/103.1; 222/505, 507, 533, 534, 535, 536

[56] References Cited

U.S. PATENT DOCUMENTS

| | | | |
|---|---|---|---|
| 3,371,827 | 3/1968 | Micallef | 222/536 X |
| 4,291,814 | 9/1981 | Conn | 220/709 |
| 4,596,341 | 6/1986 | Bruffey | 220/705 |
| 4,779,773 | 10/1988 | Bennett | 222/507 |
| 4,852,762 | 8/1989 | Chou-Sheng | 215/229 X |
| 5,085,347 | 2/1992 | Hayes et al. | 222/153 |
| 5,090,601 | 2/1992 | Thanisch | 222/507 |
| 5,109,995 | 5/1992 | Lou | 215/1 A |
| 5,150,815 | 9/1992 | Saklad | 220/708 |
| 5,265,757 | 11/1993 | Wu | 220/707 |

*Primary Examiner*—Allan N. Shoap
*Assistant Examiner*—Vanessa Caretto
*Attorney, Agent, or Firm*—Kirkpatrick & Lockhart

[57] ABSTRACT

A water bottle includes a container, a cap mounted to an upper end of the container and has two holes therein, and a cover which is mounted around the cap and is rotatable between first and second positions. When the cover is in the first position, a straw mounted on the cap is hidden inside the cover while the holes are blocked. When the cover is in the second position, the straw is rotated to extend through an opening in the cover and the holes are open to allow continuous suction of the user.

1 Claim, 4 Drawing Sheets

WATER BOTTLE WITH A HIDDEN SUCTION STRAW

BACKGROUND OF THE INVENTION

1. Field of the Invention

The present invention relates to an improved water bottle with a suction straw which, when not in use, can be hidden upon rotation of a cover.

2. Description of Related Art

A conventional water bottle generally includes a container and a cover which is used to seal the container and which can also be used as a cup for drinking water in the container. Another type of water bottle includes a container, a cap removably attached to the container, a straw passing through the cap allowing users, especially children and babies, to suck water, milk, or juice in the container, and a cover for covering the straw and/or the straw. This type of water bottle is advantageous for users to drink in moving vehicles. However, the users risk being ill if the cover for covering the straw is lost or contaminated. To solve this problem, an improved water bottle has been developed in which the straw, when not in use, is shielded in the cover upon rotation of the latter in one direction; rotation of the latter in another direction shall expose the straw again. However, after each suction, the user must release the straw to allow environmental air entering the container to compensate pressure. The present invention provides an improved water bottle to overcome this problem.

SUMMARY OF THE INVENTION

A water bottle provided by the present invention includes a container with an upper end, a cap, and a cover. The cap includes a skirt portion for releasably engaging with the upper open end of the container, a neck portion, and a circular head plate which has a diameter greater than that of the neck portion thereby defining an annular groove around the neck portion. The head plate has an outer side and an inner side and two cut edges. An arcuate stop projects from the outer side of the head plate. A neck is formed on the outer side of the head plate. First and second holes are formed in the head plate in an area defined by the neck and communicate with an inner space defined by the container. A tube extends downwardly from the inner side of the head plate for communicating the first hole and the inner space defined by the container. A suction tube is attached to a lower end of the tube.

The water bottle further includes a suction head member comprising a collar which is rotatably received in the neck and a substantially L-shaped suction straw which has a lower block end securely engaged with the collar. The collar includes an opening in an underside thereof through which the suction straw may communicate with the first hole. The collar further includes a recess in the underside thereof. A second cap is mounted around the second neck for restraining the collar in the second neck and has an opening through which the suction straw passes.

The cover includes a plurality of protrusions on an inner surface thereof for engaging with the annular groove around the neck portion of the cap. A second opening is formed in the cover and a tongue extends downwardly from the inner side of the cover. Two spaced stop pieces are formed in the inner side of the cover. The cover is rotatable between first and section positions.

By such an arrangement, when the cover is in the first position, the arcuate stop blocks the second opening in the cover to hide the suction straw and one of the stop pieces contacts with the arcuate stop to prevent rotation of the cover in one direction, while the first opening in the collar does not align with hole the first and the recess in the collar does not align with the second hole. When the cover is rotated to the second position along a direction opposite to the first mentioned direction, the tongue contacts and thus actuates the suction straw to rotate such that the distal suction end of the suction straw extends beyond the second opening in the cover until the other stop piece is stopped by the arcuate stop at the second position where the first opening in the collar aligns with the first hole and the recess in the collar aligns with the second hole. In the second position, due to the provision of the second hole, the pressure inside the container and the environmental pressure are balanced to allow continuous suction.

Other objects, advantages, and novel features of the invention will become more apparent from the following detailed description when taken in conjunction with the accompanying drawings.

DESCRIPTION OF THE PREFERRED EMBODIMENT

Figure 1:
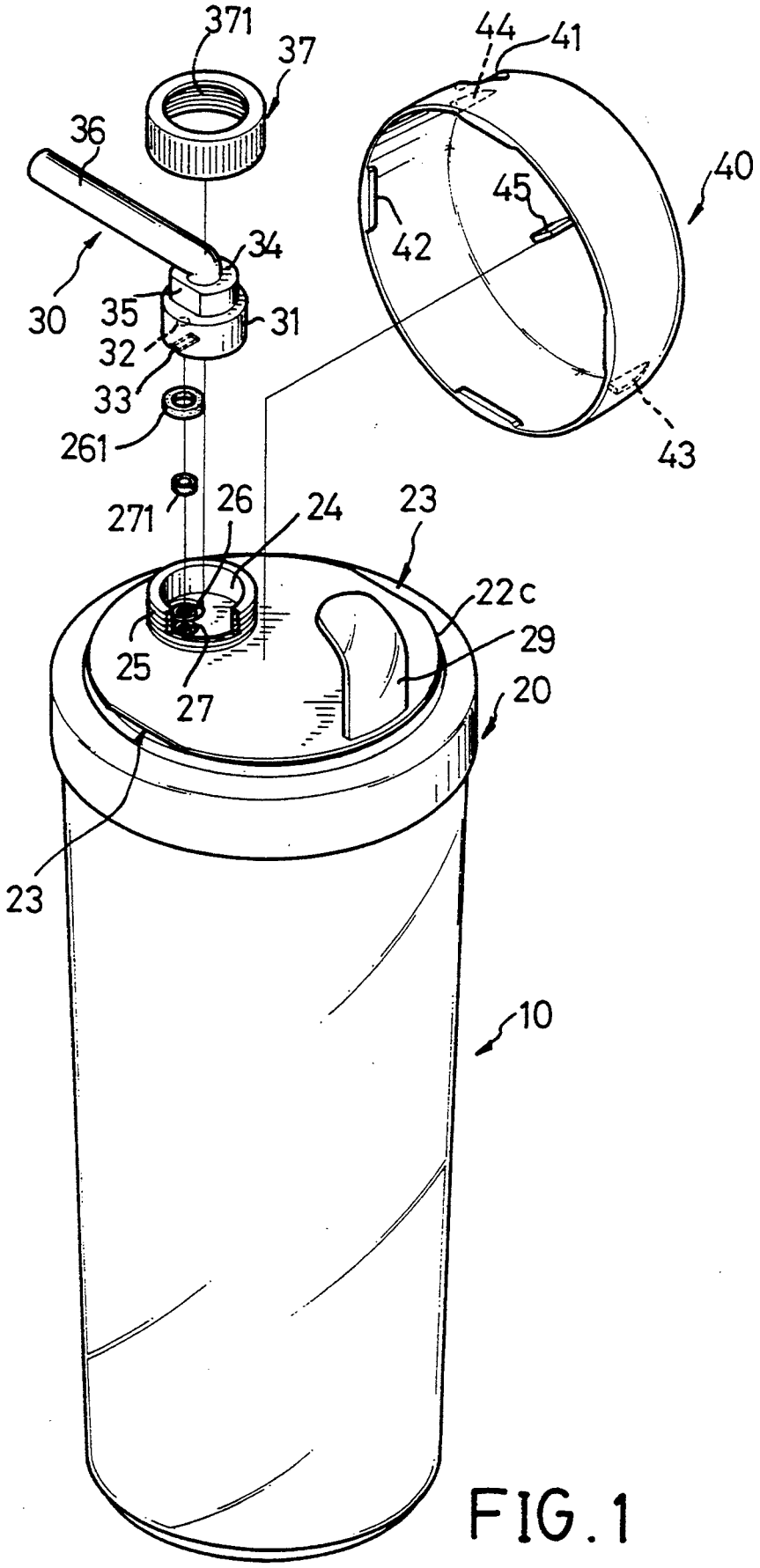
FIG. 1 is an exploded view of a water bottle in accordance with the present invention.
Figure 2:
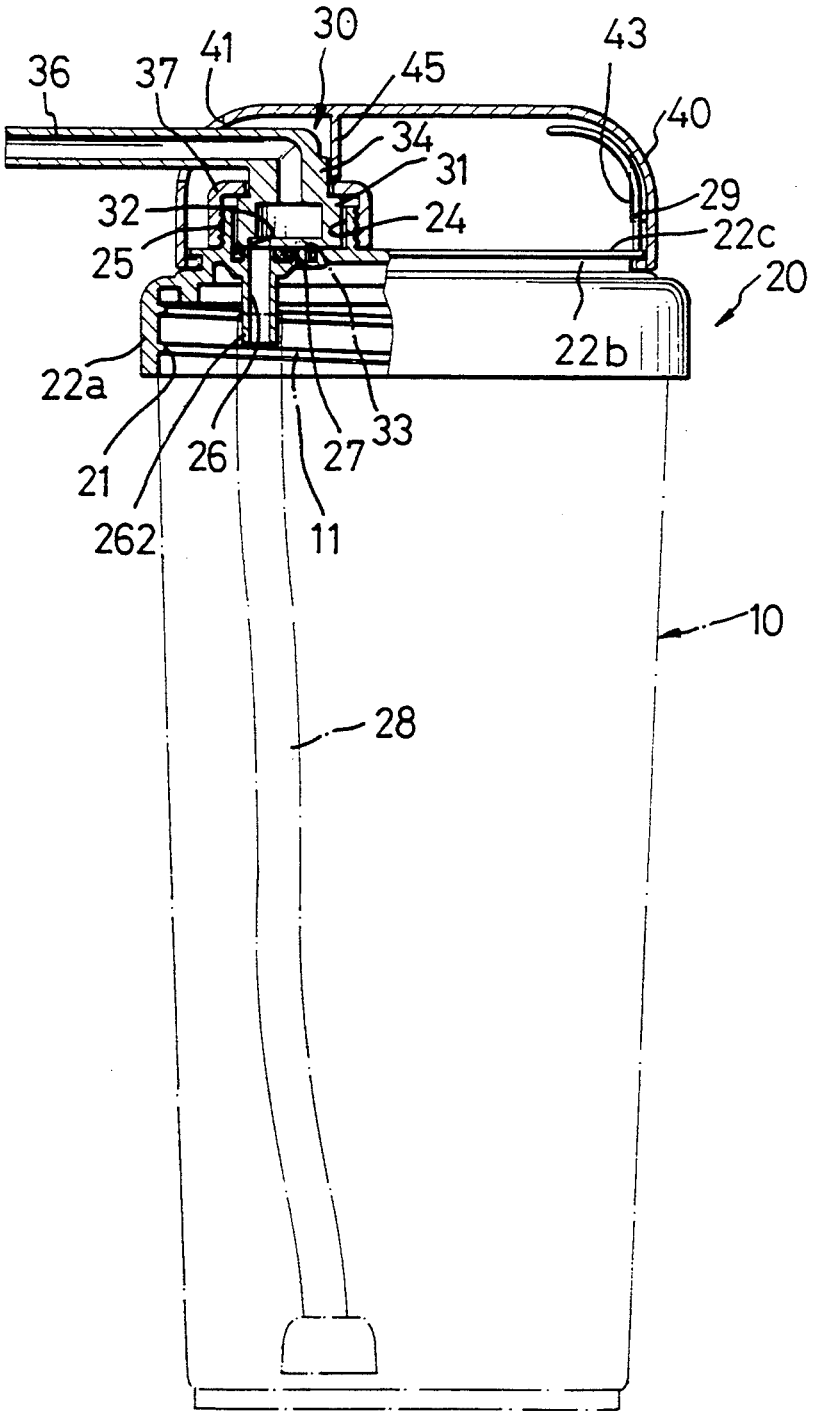
FIG. 2 is a side elevational view, partly in section, of the water bottle in accordance with the present invention.

Referring to the drawings and initially to FIGS. 1 and 2, a water bottle in accordance with the present invention includes a container 10 which has an outer threading 11 (see FIG. 2) in an upper end of a periphery thereof, a cap 20, and a cover 40. As shown in FIG. 2, the cap 20 includes a skirt portion **22*a* with a threaded inner periphery for releasably engaging with the outer threading 11, a neck portion 22*b*, and a circular head plate 22*c* with a diameter greater than that of the neck portion 22*b* thereby defining an annular groove around the neck portion 22*b***.

The head plate 22 has two cut edges 23 which are formed diametrically opposite to each other. On an upper side of the head plate 22 adjacent to the peripheral edge thereof and between the cut edges 23, an arcuate stop 29 projects upwardly and extends inwardly toward the center of the circular head plate **22*c*. Diametrically opposite to the arcuate stop 29, a neck 24 with a threaded outer periphery 25 is formed on the outer side of the head plate 22*c*. First and second holes 26 and 27 are formed in the head plate 22*c* in an area defined by the neck 24 and both holes 26 and 27 communicate with an inner space defined by the container 10. A tube 262, which communicates with the first hole 26, extends downwardly from an under side of the head plate 22*c*. A suction tube 28 is attached to the lower end of the tube 262 at an upper end thereof and with a lower end thereof slightly above the bottom of the container 10. Preferably, gaskets 261 and 271 may be respectively mounted around first and second holes 26 and 27. Hole 26 provides a passage through which water, milk, or juice in the container may be drawn out under suction, while hole 27** provides a passage for balancing pressures inside and outside the container, which will be explained later.

The water bottle further includes a suction head member 30 to communicate with hole 26. The suction head member 30 includes a collar 31 which is rotatably received in the neck 24 and a substantially L-shaped suction straw 36 which has a lower block end 34 securely engaged with the collar 31. The collar 31 includes an opening 32 in an underside thereof through which the suction straw 36 may communicate with hole 26, which will be explained later. The collar 31 further includes a recess 33 in the underside thereof, which also will be explained later.

The cover 40 is substantially dome-shaped and includes four equidistantly formed protrusions 42 on an inner peripheral edge thereof for engaging with the annular groove between the head plate **22*c* and the neck portion 22*b*. An opening 41 is formed in a periphery of the cover 40 and a tongue 45 extends downwardly from the top of an inner side of the cover 40. Two spaced stop pieces 43 and 44 are formed in the inner side of the cover 40**.

In assembly, the suction straw 36 is passed through a second cap 37 with a threaded inner periphery 371. The lower block end 34 is securely received in the collar 31, which, in turn, is rotatably received in the neck 24. Preferably, the lower block end 34 has a vertical planar edge 35, and the collar 31 has a corresponding vertical planar section (not labeled) to fittingly receive the lower block end. After screwing the second cap 37 around the neck 24, the lower block end 34 shall protrude beyond the second cap 37, as shown in FIG. 2. Thereafter, the cover 40 is forcibly mounted onto the cap 20 such that the protrusions 42 engage with the annular groove between the plate 22 and the cap 20.

Figure 3:
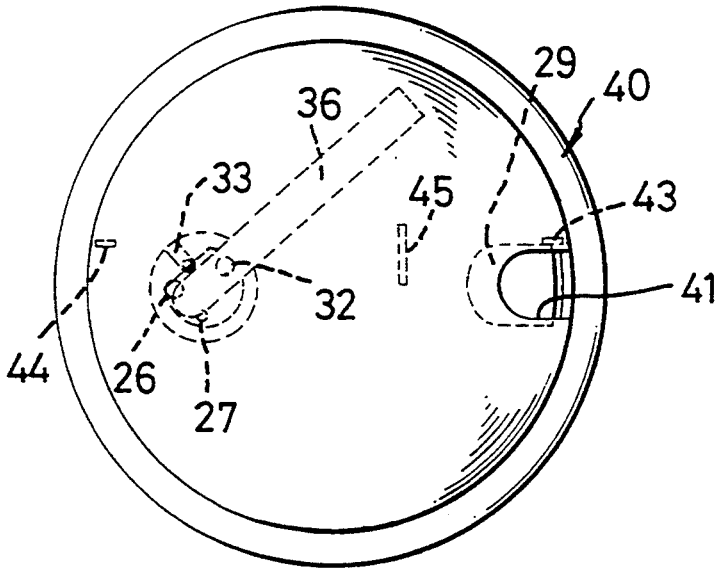
FIG. 3 is a top plan view, of the water bottle in a closed position.

Referring now to FIG. 3, the water bottle is now in a closed position in which the arcuate stop 29 blocks the opening 41, while one of the stop pieces 43 engages with an edge of the arcuate stop 29 to prevent clockwise rotation of the cover 40. In this position, the suction straw 36 is hidden inside the cover 40 as shown by the dash lines in this figure. Furthermore, the opening 32 does not align with hole 26, while recess 33 does not align with hole 27.

Figure 4:
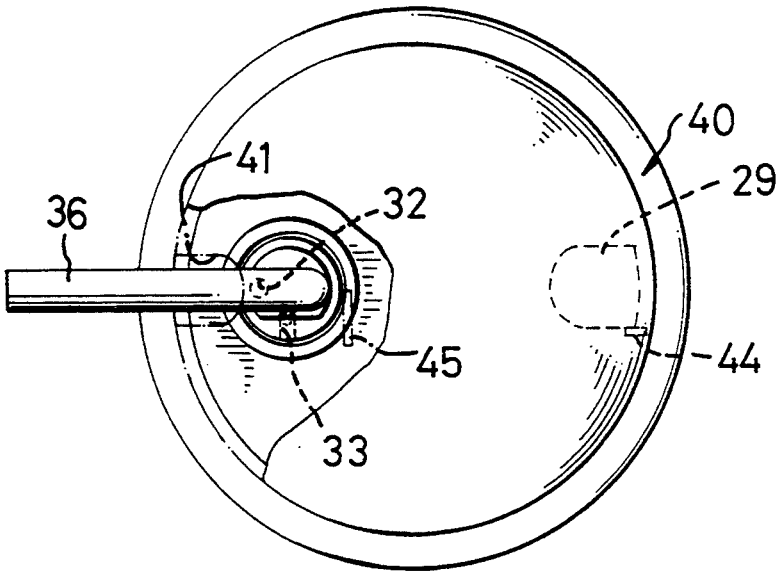
FIG. 4 is a top plan view, partly cutaway, of the water bottle in an open position.
Figure 5:
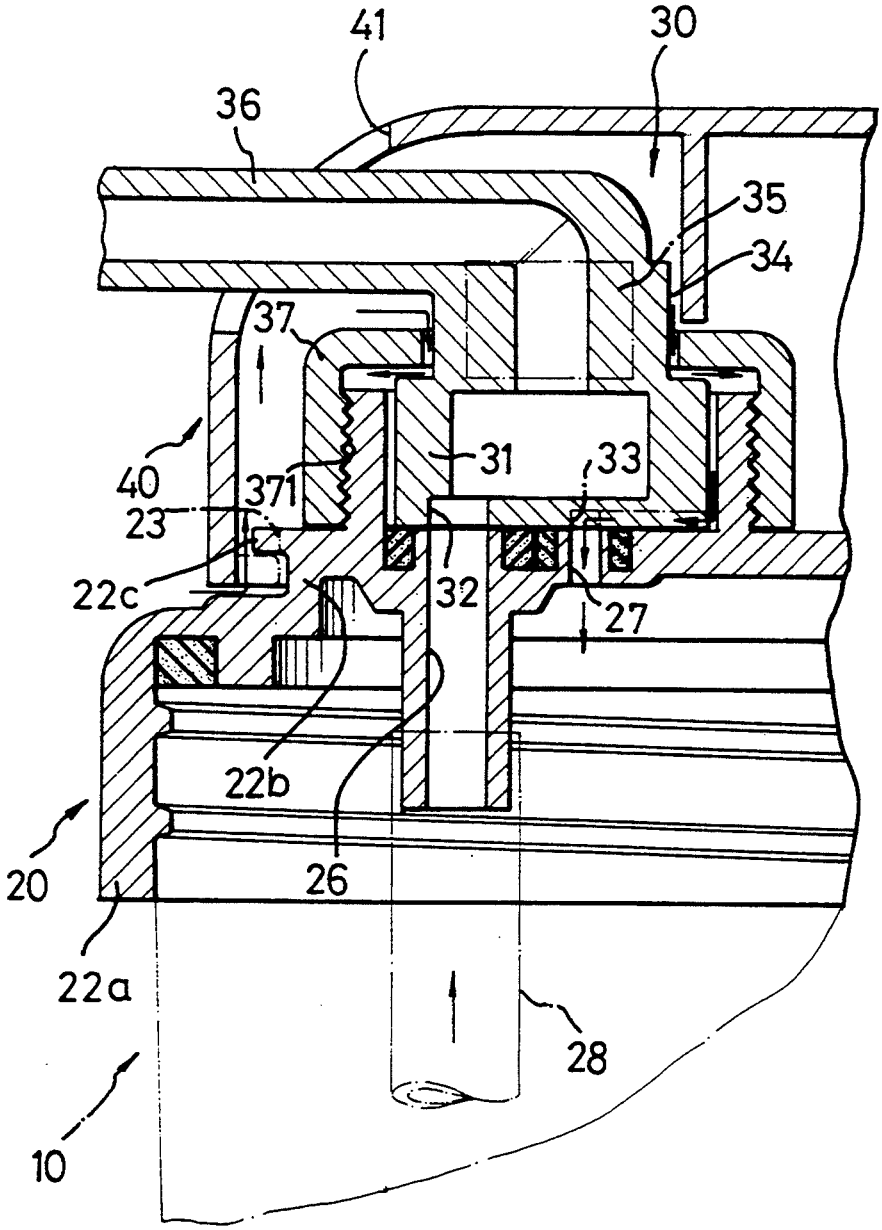
FIG. 5 is a partial cross-sectional view, in an enlarged scale, of the water bottle in an open position.

Upon counterclockwise rotation of the cover 40, the tongue 45 contacts and thus actuates the suction straw 36 to rotate such that the distal suction end of the suction straw 36 gradually extends beyond the opening 41 in the cover 40 until the other stop piece 44, after rotation, is stopped by the other edge of the arcuate stop 29, as shown in FIG. 4. In this position, as shown in FIG. 5, the opening 32 aligns with hole 26, while recess 33 aligns with hole 27. When sucking, environmental air enters the cover 40 via the cut edges 23 of the head plate **22*c* and then passes through the gap (not labeled) between the second cap 37 and the lower block end 34 of the suction straw 36 and further passes through another gap (also not labeled) between the neck 24 and the collar 31, thereby entering the container 10 via hole 27**. By this arrangement, the pressures inside the container and of the environment are balanced to allow continuous suction.

Although the invention has been explained in relation to its preferred embodiment, it is to be understood that many other possible modifications and variations can be made without departing from the spirit and scope of the invention as hereinafter claimed.

I claim:

1. A water bottle comprising:

a container with an upper open end;

a cap comprising a skirt portion for releasably engaging with the upper open end of the container, a neck portion, and a circular head plate which has a diameter greater than that of the neck portion thereby defining an annular groove around the neck portion, the head plate having an outer side and an inner side and at least one cut edge, an arcuate stop projecting from the outer side of the head plate, a second neck being formed on the outer side of the head plate, first and second holes being formed in the head plate in an area defined by the second neck and communicating with an inner space defined by the container;

a suction head member including a collar which is rotatably received in the second neck and a substantially L-shaped suction straw which has a lower end securely engaged with the collar, the collar including an opening and a recess in an underside thereof, a second cap being mounted around the second neck for restraining the collar in the second neck and having an opening through which the suction straw passes; and a cover including a plurality of protrusions on an inner surface thereof for engaging with the annular groove around the neck portion of the cap, a second opening being formed in the cover and a tongue extending downwardly from the inner surface of the cover, two spaced stop pieces being formed in the inner surface of the cover, the cover being rotatable between first and second positions;

wherein when the cover is in the first position, the arcuate stop blocks the second opening in the cover to hide the suction straw and one of the stop pieces contacts with the arcuate stop to prevent rotation of the cover in one direction, while the first opening in the collar does not align with the first hole and the recess in the collar does not align with the second hole, when the cover is rotated along a direction opposite to the first mentioned direction to the second position, the tongue contacts and thus actuates the suction straw to rotate such that a distal suction end of the suction straw extends beyond the second opening in the cover until the other stop piece is stopped by the arcuate stop at the second position where the first opening in the collar aligns with the first hole and the recess in the collar aligns with the second hole.

* * * * *